US005383584A

United States Patent [19]

Adams

[11] Patent Number: 5,383,584

[45] Date of Patent: Jan. 24, 1995

[54] FOLDABLE HANGER

[76] Inventor: Michael E. Adams, 2009 Walters Ave., Northbrook, Ill. 60092

[21] Appl. No.: 54,965

[22] Filed: Apr. 28, 1993

[51] Int. Cl.[6] ..... A47G 25/40

[52] U.S. Cl. ..... 223/94; 223/89

[58] Field of Search ..... 223/89, 85, 94, 92, 223/88, 90; D6/315; 211/113

[56] References Cited

U.S. PATENT DOCUMENTS

| | | | |
|---|---|---|---|
| 589,901 | 9/1897 | Lincoln et al. . | |
| 923,786 | 6/1909 | Geraci . | |
| 959,687 | 5/1910 | Altermatt . | |
| 1,286,022 | 11/1918 | Kleset . | |
| 1,955,995 | 4/1934 | Wood | 223/89 |
| 2,290,722 | 7/1942 | Weingarten . | |
| 2,425,475 | 8/1947 | Isaacson . | |
| 2,509,754 | 5/1950 | Badalamenti . | |
| 2,518,367 | 8/1950 | Penhallegon . | |
| 2,906,442 | 9/1959 | McNutt . | |
| 3,531,028 | 9/1970 | Vazquez . | |
| 4,114,786 | 9/1978 | Wiese . | |
| 4,117,960 | 10/1978 | Bengsch et al. . | |
| 4,221,310 | 9/1980 | Hazenfeld | 223/94 |
| 4,227,632 | 10/1980 | Collis . | |
| 4,673,115 | 6/1987 | LaMont . | |
| 4,813,581 | 3/1989 | LaMont . | |
| 4,948,019 | 8/1990 | Rodum | 223/94 |
| 4,988,021 | 1/1991 | Adams et al. . | |

FOREIGN PATENT DOCUMENTS

| | | |
|---|---|---|
| 157082 | 9/1939 | Germany . |
| 1429922 | 4/1963 | Germany . |
| 7607305 | 1/1977 | Netherlands . |

*Primary Examiner*—Clifford D. Crowder
*Assistant Examiner*—Bibhu Mohanty
*Attorney, Agent, or Firm*—Olson & Hierl, Ltd.

[57] ABSTRACT

An improved unitary molded foldable changer is provided for garments and the like. The hanger incorporates a pair of garment supporting arms which articulate between an outwardly extended opposed relationship and a lowered adjacent relationship about a hinge positioned between bottom portions of each arm shoulder. An upwardly arcuate elongated link is interconnected at each of its respective opposite ends through a hinge to a different respective one of the arm shoulder top portions which are in longitudinally spaced relationship to one another. The link further includes a mid-location hinge, and a latch assembly for cross connection, and an integral hook for engagement with a closet bar or the like. The link is so configured that, when the arms are in the extended and garment supporting position, the hook is suitably oriented and the latch assembly is engaged to lock the arms in the extended position. When the arms are in the collapsed position, a detent member on each underside of each arm is engagable with the other to lock the arms together for transport or storage purposes. The hanger can be opened or closed using one hand.

13 Claims, 3 Drawing Sheets

12
11
16
19
21
22
23
26
27
28
29
31a
31b
31c
31d
31e
32a
32b
32c
32d
32e
33
34
35
37
38
39
41
41a
41b
42
42a
42b
43
49
49a
49b
50b
50c
51
52
53
54
16a
16b
17
18
50a

FOLDABLE HANGER

FIELD OF THE INVENTION

This invention relates to foldable garment hangers and particularly to hangers comprised of unitary molded plastic and incorporating pivotable arms, bendable links, hinges and latches.

BACKGROUND OF THE INVENTION

A unitary (i.e., one-piece) molded plastic foldable garment hanger is shown and described in my prior patent, Adams et al. U.S. Pat. No. 4,988,021. Although that hanger is very useful, the hanger may have certain disadvantages.

For one thing, that hanger has many flexible connections between adjacent components. Also, the hanger has a relatively complex latching mechanism. Further, that hanger requires a relatively complex forming mold with many spaced, adjacent surfaces and interconnecting cavities so that the mold can be expensive to make, maintain and use. The many interconnected parts and relatively complicated latching mechanism in that hanger suggest a greater risk of product failure than would be expected to exist inherently with another functionally similar product that had fewer interconnected parts and a simpler latching mechanism.

To circumvent these potential disadvantages, a new simplified and reliable unitary folding hanger structure is needed. My present invention supplies this need.

SUMMARY OF THE INVENTION

This invention is directed to a foldable garment hanger of unitary plastic construction which incorporates a pair of opposed, pivotable, garment-supporting arms that can be articulated between open (i.e., unfolded and assembled) and closed (i.e., folded and disassembled) positions.

The articulation is achieved by means of a combination of hinges and an integral interconnecting bendable link that extends between the shoulders of the arms. Preferably, the link itself incorporates hinge means and so is thereby foldable.

Latches are provided for maintaining the arms in their respective fully open (i.e., fully assembled) and fully closed (i.e., fully disassembled) positions.

The hanger is simple and easy for the user to open or close. Moreover, the hanger can be either opened or closed using one hand.

The hanger can be readily formed in low cost, so-called "straight pull" tooling using conventional plastic injection molding equipment.

Moreover, the hanger employs relatively few flexible interconnections and interconnected movable parts, and incorporates a simple, reliable latching mechanism.

In addition, the hanger structure is reliable, durable, low in cost to produce, and is believed to have an indefinitely long duty life.

The hanger is believed to offer features and use advantages, including structural simplicity and reliability, that have not previously been available so far as now known in a foldable plastic garment hanger.

These and other objects, aims, purposes, features, benefits, advantages, embodiments and the like will be apparent to those skilled in the art from the present specification taken with the accompanying drawings.

DETAILED DESCRIPTION

FIGS. 1–7 show one embodiment of a foldable garment hanger 10 according to the present invention. Hanger 10 is comprised of molded plastic and has a unitary, one-piece construction.

Figure 1:
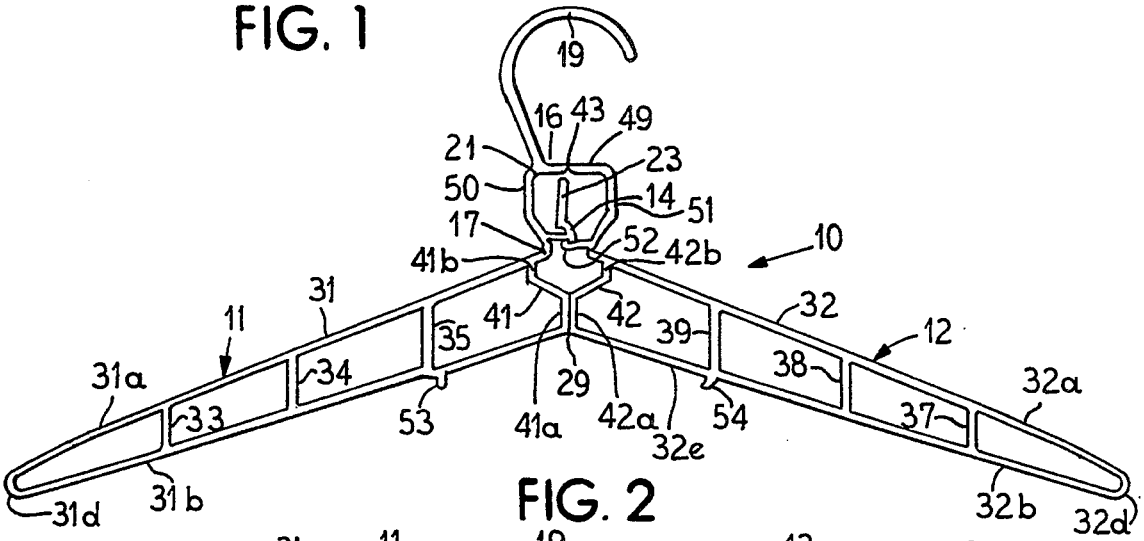
FIG. 1 is a side elevational view of one embodiment of a foldable hanger of this invention showing the hanger in its unfolded, fully assembled, open and latched configuration.
Figure 5:
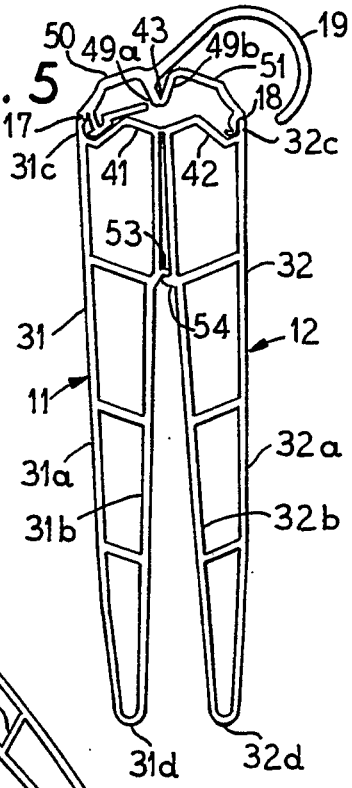
FIG. 5 is a side elevation of the hanger embodiment shown in FIGS. 1–4, but with the hanger in its folded, fully disassembled, closed and latched configuration.

Hanger 10 incorporates a pair of arms 11 and 12 which can be articulated in longitudinally opposed relationship to each other between a fully open position as shown in FIG. 1, and a fully closed position as shown in FIG. 5. Various plastics can be employed; however, it is presently preferred to employ a thermoplastic polypropylene (including homopolymers, copolymers with other monomers, polyblends or the like) due to the capacity of such a polymer to be molded into a body which incorporates intregal, or so-called "living hinges".

Each arm 11 and 12 is generally symmetrically configured and similarly sized relative to the other arm. Each arm 11 and 12 is formed along its sides and outer end by an elongated, longitudinally extending perimeter strip 31 and 32, respectively, which generally has an elongated V-configuration and which is provided with a plurality of structurally reinforcing, shape-retaining, longitudinally spaced cross braces.

In embodiment 10, arms 11 and 12 are each illustratively and preferably provided with three straight laterally extending cross braces that are identified respectively as 33, 34 and 35, and 37, 38 and 39, respectively. The cross braces extend in longitudinally spaced, parallel relationship to each other laterally between the upper portion 31*a* and the lower portion 31*b* of the strip 31, and similarly between the upper portion 32*a* and the lower portion 32*b* of the strip 32.

Each arm 11 and 12 commences in a shoulder region that is generally defined by a preferably non-linear cross brace 41 and 42, respectively. Each cross brace 41 and 42 has its lower end longitudinally offset relative to its upper end, thereby effectively making the lower leg 31*b* and 32*b* of each respective perimeter strip 31 and 32 somewhat longer than the upper leg 31*a* and 32*a*. The cross braces 41 and 42 are, in effect, mirror images of each other (in side elevation).

The terminal end of the lower portion 31*b* and 32*b* of each respective perimeter strip 31 and 32 is in aligned adjacent relationship with the other, and these terminal ends are interconnected together by a transversely extending, relatively thin rectilinear section or hinge 29 adjacent to the outside face of lower portions 31*b* and 32*b*. Section 29 preferably extends across the entire transverse width of the adjoining terminal ends of the lower portions 31*b* and 32*b*. The arm 11 is pivotable relative to the arm 12 about section 29. Section 29, in effect, thus acts as the pivotal portion in the pintle region of a hinge.

In hanger 10 assembly, the upward and outward movement of the arm 11 relative to the arm 12 is limited by the position where the lower sections 41*a* and 42*a* achieve abutting engagement with each other. When the arms 11 and 12 are in their extended and hanger 10 assembled, unfolded, and normal use configuration as shown in FIG. 1, the lower straight section 41*a* and 42*a* of each cross brace 41 and 42 abuttingly engage and thereby limit or prevent further pivotal extension of the arms 11 and 12.

The terminal shoulder ends 31*c* and 32*c* of the upper portions 31*a* and 32*a* of each respective perimeter strip 31 and 32 project a short distance longitudinally beyond the location where the upper end 41*b* and 42*b* of each cross brace 41 and 42 is adjoined thereto. Between ends 31*c* and 32*c*, an elongated, generally arcuately extending bendable or foldable link 16 is interconnected. The transverse width of link 16 is preferably similar to the preferably matching transverse widths of the perimeter strips 31 and 32. The respective opposite end regions 16*a* and 16*b* of link 16 are each joined to a different respective one of the ends 31*c* and 32*c* by a transversely extending, relatively thin rectilinear section or hinge 17 and 18, respectively. Each section 17 and 18 preferably extends across the entire transverse width of the strips 31 and 32 and link 16.

Thus, the arm 11 is pivotable relative to link 16 about section 17, and the arm 12 is pivotable relative to link 16 about section 18. Sections 17 and 18, in effect, each act as the pivotal portion in the pintle region of a hinge during pivotal movements of the arms 11 and 12.

In hanger 10 assembly, the increasing upward and outward movement of the arm 11 relative to the arm 12 causes the link 16 to assume an increasingly acute C-shaped configuration (in side elevation) which reaches a maximum and final form when the lower sections 41*a* and 42*a* of braces 41 and 42 abuttingly engage as indicated above. The final form of the C-shaped configuration of link 16 is as illustratively shown in FIG. 1 (also see FIG. 6).

In its final C-shaped configuration when the hanger 10 is fully assembled, the link 16 includes a base 49 which is positioned above the arms 11 and 12 and which preferably has a generally straight form in the assembled hanger 10. The base 49 has a pair of adjoining and generally symmetrically positioned and extending legs 50 and 51. The length of the base 49 is generally preferably greater than the width of the mouth 52 of the C-shaped configuration, and the lower terminal portion 50*a* and 51*a* of each leg 50 and 51 is preferably inclined or angled in an opposed inward direction before becoming terminally joined to the sections 17 and 18. The term "C-shaped" in the final condition refers to the entire link 16 shape. In it's final C-shaped configuration the extended legs 50 and 51 are spaced apart from each other with the hinge 43 in the spaced apart condition as seen in FIG. 6.

Figures 6, 7:
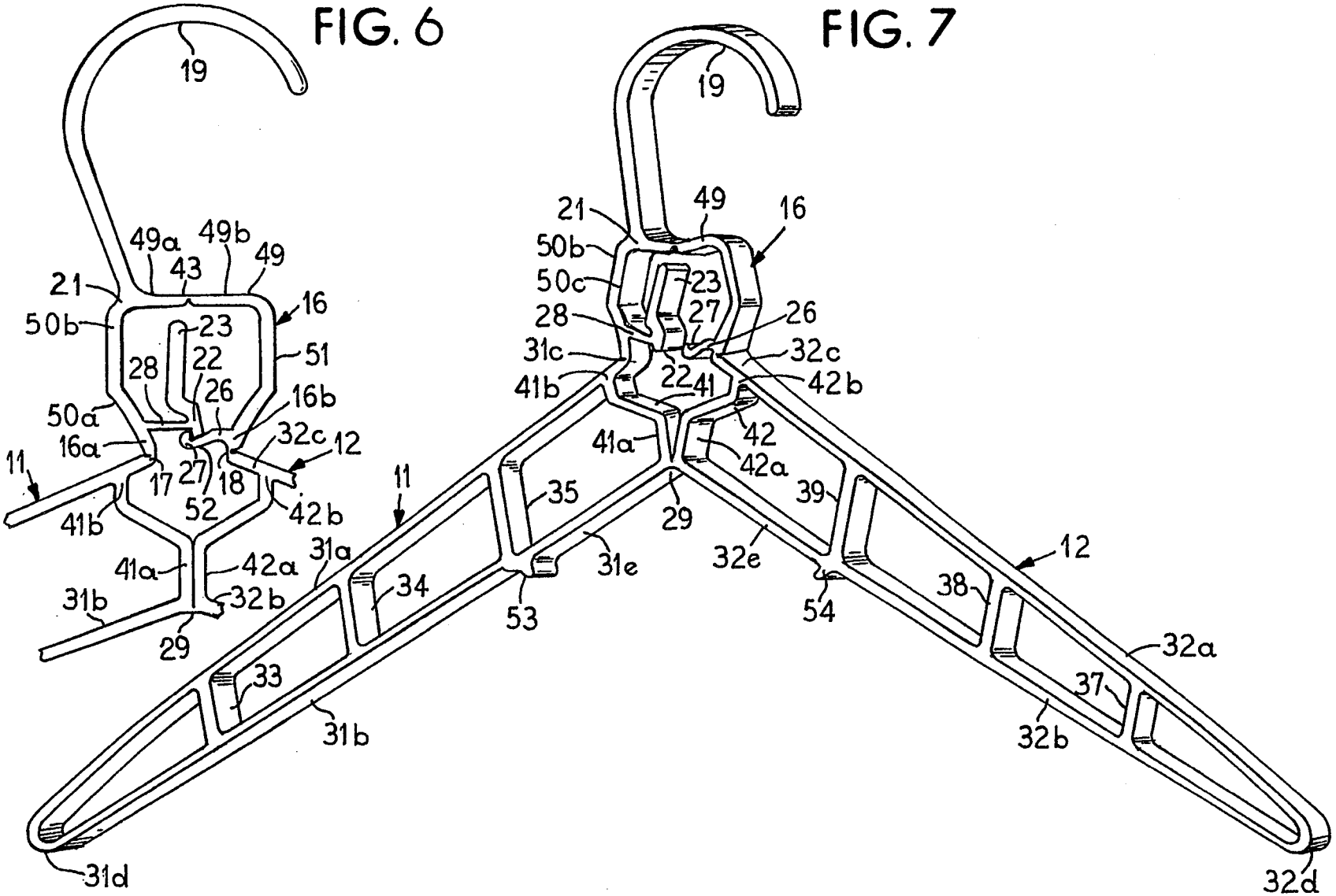
FIG. 6 is an enlarged, fragmentary detail view in side elevation showing details of the shoulder, link, hook and collapsing mechanism of the hanger embodiment of FIG. 1.
FIG. 7 is an enlarged perspective view showing the hanger embodiment FIG. 1 in the general configuration shown in FIG. 4.

In order to achieve unresisted and predictable changes in the configuration of link 16 during hanger 10 assembly and disassembly, and to aid in achieving the symmetrical C-shaped configuration (in side elevation) shown in FIG. 1 and FIG. 6, the base 49 of link 16 is preferably provided in a mid-region thereof with a transversely extending, relatively thin rectilinear section or hinge 43 that is adjacent to the outer face of link 16. The section 43 preferably extends across the entire transverse width of the base 49. The two adjoining portions 49*a* and 49*b* of base 49 are thus pivotable relative to each other about section 43. Section 43 thus acts as the pivotal portion in the pintle region of a hinge.

In assembly, the upward and outward movements of the arms 11 and 12 relative to each other produce pivotable movements of portions 49*a* and 49*b* about section 43 in link 16 so that, when each is generally coextensive relative to the other, the base 49 achieves its generally preferred straight form in the assembled hanger 10. During these pivotal movements of arms 11 and 12, some flexural movement may occur in and along link 16, such as at locations where the terminal portions 50*a* and 51*a* join their adjacent portions of each leg 50 and 51.

A hook 19 that is conveniently sized for engagement over a closet bar (not shown) or the like outwardly extends from integral association with a portion of link 16. Although alternative hook connecting arrangements and locations are possible, the presently preferred one is as shown in the FIGS. 1–7 and involves the positioning of the base 21 of hook 19 in the region of the joining between the upper end of leg 50 and one end of the portion 49*a* of the base 49 of link 16. The base 49 in effect constitutes the uppermost portion of link 16 when the hanger 10 is in its assembled configuration as shown, for example, in FIG. 1. For purposes of strength, transverse stability and load bearing capability, the upper portion of leg 50 can be preferably longitudinally thickened (as distinct from transversely for ease in molding).

To stabilize and secure the arms 11 and 12 in the assembled hanger 10 use configuration shown in FIG. 1, a latch assembly is provided. Various latch assemblies and variations in latch assembly location can be used. Preferably, hanger 10 employs a latch assembly 14 that is positioned just above, and extends across, the mouth 52 of the C-shaped configuration of the link 16 when the hanger 10 is in its assembled configuration as shown in FIG. 1.

Thus, adjacent to section 18 in portion 51*a*, a flattened, inwardly extending bar 26 is formed which is provided with a terminal transversely extending, upwardly opening notch 27. Bar 26 extends generally part way across and above mouth 52 preferably towards end region 16*a*. Similarly, adjacent to section 17 in portion 50*a*, a resiliently laterally deflectable latch plate 28 is formed with a terminal, downwardly projecting, transversely extending catch 22. The catch 22 is sized and positioned spatially so as to be engagable with notch 27, and, when so engaged, catch 22 is preferably somewhat yieldingly biased into an engaged relationship with notch 27. This biasing is conveniently achieved by the particular projection angle of latch plate 28 from portion 50*a* and the position of notch 27. The latch plate 28 is preferably terminally associated with an upstanding trigger lever 23 that is located adjacent to the catch 22 so that a finger (not shown) of a user can be readily engaged therewith for purposes of deflecting the latch plate 28 to engage or disengage (as the case may be) the catch 22 from the notch 27 during assembly or disassembly of hanger 10.

Preferably, the configuration and orientation of the hanger 10 components is such that, during opening of hanger 10, the catch 22 is yieldingly biased by latch plate 28 and is adapted to be self-engaging with the notch 27. Trigger lever 23 is then employed only during latch disengagement.

Preferably, the interrelationship between the latch assembly 14 and the hook 19 is such that, when hanger 10 is fully assembled and latched, and the hook 19 is engaged fully and properly with a closet bar (not shown), the hanger 10 is in a centered and balanced relationship so that the arms 11 and 12 tend to hang in equally spaced relationship relative to the closet bar.

Thus, the arms 11 and 12, the link 16, and the hook 19 are interconnected with one another and movable relative to one another by the sections 17, 18, 29 and 43 which form integral or so-called "living" hinge means. These sections are, as shown, preferably generally equally spaced from one another, and their configuration can be compared to the respective corners or points of a four-sided "diamond" configuration that is flattened out when the hanger 10 is in its collapsed or storage configuration and that is erected or elongated when the hanger 10 is in its open or assembled configuration.

Particularly when the hanger 10 is in its assembled configuration, the legs 50 and 51 each define (in cooperation with adjacent components) a matching concavely curved recess along outside edge portions thereof just above the sections 17 and 18.

The hanger 10 is openable from a disassembled storage configuration as shown is FIG. 5 into an assembled use configuration as shown in FIG. 1 with one hand, and also hanger 10 is closable from the assembled use configuration into the disassembled storage configuration with one hand.

Thus, when the user desires to assemble the hanger 10, the thumb and forefinger of one hand apply opposed squeezing pressure against a different one of the respective concave Outer surfaces of the lower terminal portions 50*a* and 50*b* of legs 50 and 51. This produces a simultaneous pivoting of each of the hanger arms 11 and 12 about section 29, while causing the legs 50 and 51 of link 16 to pivot about sections 17 and 18, respectively, and also the base portions 49*a* and 49*b* to pivot about sections 43. The squeezing results in pivotal movement of the hook 19, the link 16 and the arms 11 and 12. These pivotal movements continue until straight sections 41*a* and 42*a* of cross braces 41 and 42, respectively, abuttingly engage and hook 19 is in its erect position. Latch assembly 14 becomes engaged and arms 11 and 12 are locked in their open, garment supporting positions. Hook 19 is also positioned so as to be engagable with a closet bar. Hanger 10 can thus be assembled using only one hand.

Figure 2:
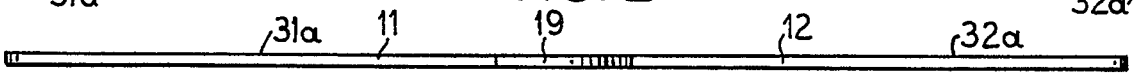
FIG. 2 is a top plan view of the hanger embodiment shown in FIG. 1.
Figure 3:
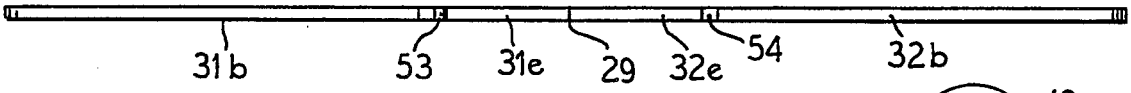
FIG. 3 is a bottom plan view of the hanger embodiment shown in FIG. 1.
Figure 4:
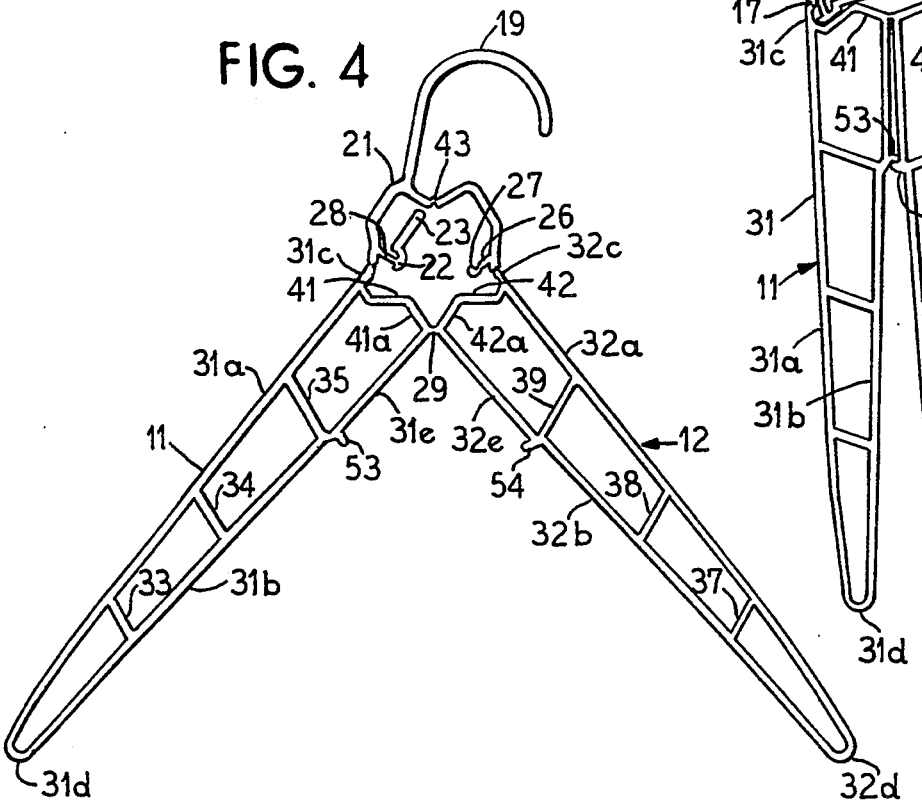
FIG. 4 is a side elevational view of the hanger embodiment shown in FIGS. 1–3, but with the hanger in a configuration that is between its fully assembled and fully disassembled configurations.

In the fully assembled form shown in FIG. 1, the hanger 10 preferably has a longitudinally flattened edge configuration as illustrated in FIGS. 2 and 3. The latter Figures also illustrate that the transverse thickness of the individual various component portions of the hanger 10 have similar widths. However, various hanger configurations are possible.

Conversely, when the user desires to disassemble the hanger 10, the catch 22 is conveniently disengaged from the notch 27 by deflecting the latch plate 28 through finger pressure applied to trigger lever 23. The middle finger and the thumb of one hand are each positioned upon a different upper outer surface of the legs 50 and 51. The index finger of the same hand engages the trigger lever 23 to release the catch 22 from the notch 27, thereby unlocking the latch assembly 14. At this time, either the user's finger pressure, or the weight of a garment on the top surfaces of each arm 11 and 12, cause base portions 49*a* and 49*b*, legs 50 and 51 of link 16, and arms 11 and 12 to begin pivoting about their associated hinges until hanger 10 has collapsed into the fully disassembled configuration shown in FIG. 5. The arms 11 and 12 are thus pivoted downwardly into the arm orientation shown in FIG. 5 about a pivot axis provided by section 29. Also, during disassembly, pivoting action simultaneously occurs at sections 17 and 18, the mouth 52 widens, and ends 16*a* and 16*b* of link 16 move away from each other. Pivoting action also concurrently occurs at section 43 resulting in the downward spatial movement of section 43, together with its associated adjoining base portions 49*a* and 49*b*. The distance between sections 43 and 29 is thus reduced until the relationship shown in FIG. 5 is reached where base portions 49*a* and 49*b* are inclined at an acute angle relative to each other and where the arms 11 and 12 extend downwardly in a symmetrical and adjacent relationship relative to each other.

To hold the arms 11 and 12 in this adjacent and disassembled storage configuration as shown in FIG. 5, a pair of dog-type detents 53 and 54 are provided. Each detent 53 and 54 is located so as to be in generally opposed relationship relative to the other when the arms 11 and 12 are in such a storage configuration with each detent 53 and 54 outwardly projecting from a different respective one of the lower perimeter strips 31*b* and 32*b*. The individual configuration and the relationship between the detents 53 and 54 is such that when the arms 11 and 12 are in the adjacent relationship shown in FIG. 5, the detents 53 and 54 have interengagable adjacent surface portions. When these respective surface portions are overlapped by being pressed together by user manual pressure or the like and thereby become engaged, they retain an interengaged relationship in a snap-fit engagement.

The appearance of the interengaged detents 53 and 54, by present preference, is shown in side elevation in FIG. 5. However, various alternative interfitting and retaining latching means can be employed for associating the arms 11 and 12 together for purposes of achieving a stable disassembled configuration for hanger 10 during storage or the like. Unlatching or dissociation of detent 53 from detent 54 is preferably conveniently achieved by the user manually applying leverage in an opposed direction against the remote opposed respective ends 31*d* and 32*d* of each arm 11 and 12, or otherwise as desired. Preferably, the detents 53 and 54 are located generally opposite or near the vicinity of the cross braces 35 and 39, respectively.

A feature of the present hanger 10 is that, when the hanger 10 is in the disassembled and latched configuration illustrated in FIG. 5, the hanger 10 is still in a flattened configuration with a transverse thickness no greater than that shown in FIGS. 2 and 3. Such a flattened configuration is achieved by the preferably non-interfering relationship that exists between the components associated with the link 16, particularly the hook 19 and the latch assembly 14 (including the bar 26, the notch 27, the latch plate 28, the catch 22, and the trigger lever 23, all of the latch assembly 14). To aid in achieving this flattened, non-interfering component interrelationship, the terminal portions 31*e* and 32*e* of the lower strips 31*b* and 32*b* are preferably (and as shown) laterally and outwardly (downwardly relative to the assembled hanger 10) offset relative to the strips 31*b* and 32*b*. Such an offset, in effect, lowers the position of the section 29 and shortens the projecting lengths of the detents 53 and 54.

Figure 8:
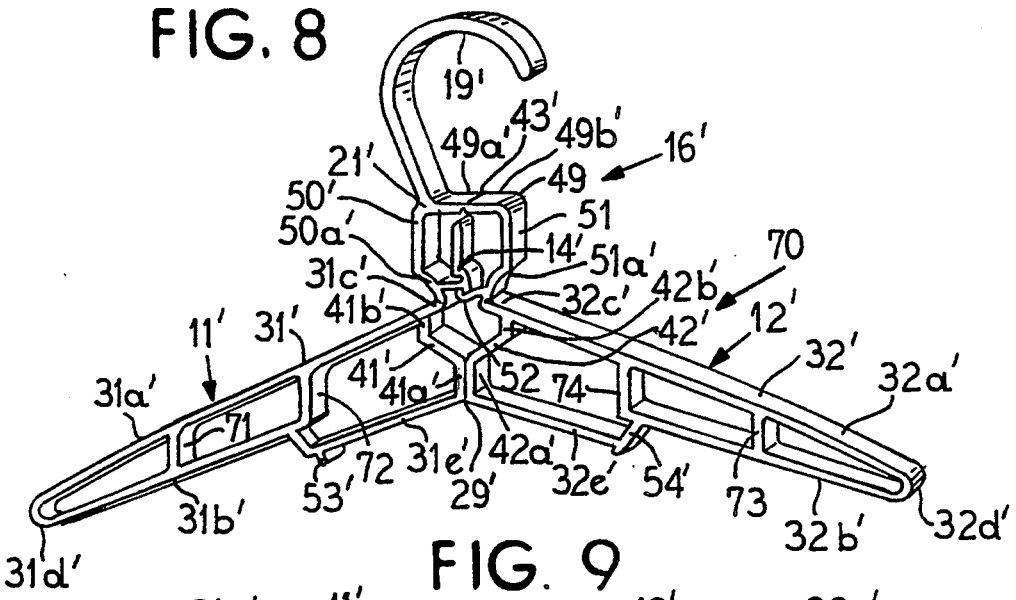
FIG. 8 is a view similar to FIG. 7, but showing an alternative embodiment of a foldable hanger of this invention.
Figure 9:
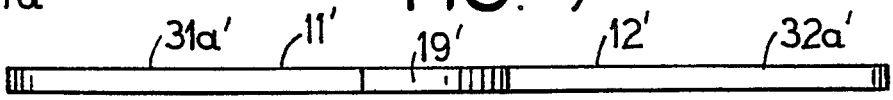
FIG. 9 is a top plan view of the hanger embodiment shown in FIG. 8.
Figure 10:
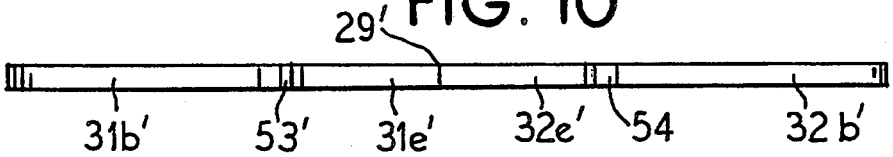
FIG. 10 is a bottom plan view of the hanger embodiment shown in FIG. 8.

Modifications and alternative hanger embodiments are possible without departing from the invention as those skilled in the art will appreciate. One alternative embodiment is shown in FIGS. 8–12 which is designated in its entirety by the numeral 70. Portions and components of hanger 70 which correspond to, or are similar to, those in hanger 10 are similarly numbered, but with the addition of prime marks thereto for identification purposes. Hanger 70 has arms 11' and 12' which are each generally shorter in length than the corresponding respective arms 11 and 12 of hanger 10, so that the hanger 70 is suitable for suspending children's garments or the like when it is in its assembled configuration as shown in FIG. 8. In place of the cross braces 33, 34 and 35 in arm 11, the arm 11' employs the cross braces 71 and 72, and in place of the cross braces 37 38 and 39 in arm 12, the arm 12' employs the cross braces 73 and 74.

Figure 12:
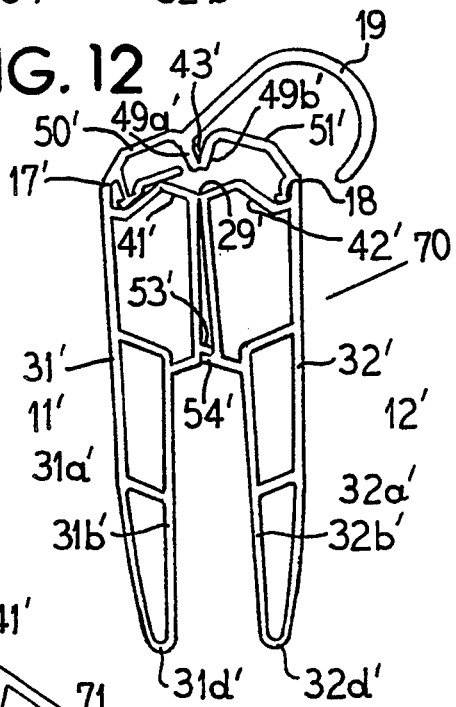
FIG. 12 is a view similar to FIG. 5, but showing the hanger embodiment of FIG. 8.
Figure 11:
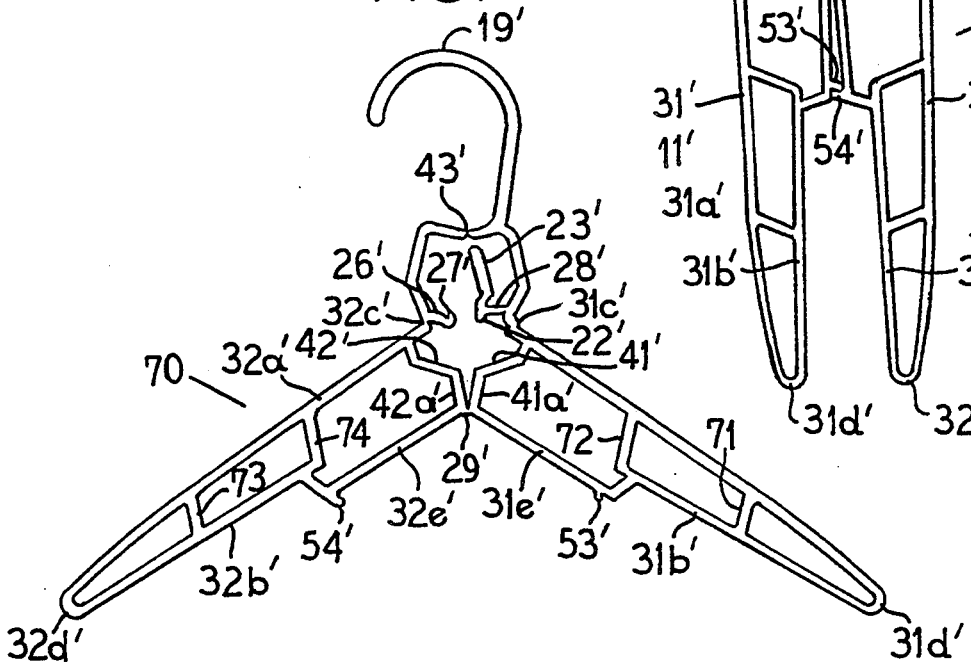
FIG. 11 is a view similar to FIG. 4, but showing the reverse side of the hanger embodiment of FIG. 8.

In the arms 11' and 12', the terminal portions 31*e'* and 32*e'* are each outwardly offset relative to the strips 31*b'* and 32*b'* to a somewhat greater extent than the terminal portions 31*e* and 32*e* of the arms 11 and 12. This arrangement permits the arms 11' and 12' to extend in an adjacent and parallel manner relative to each other when the hanger 70 is in its collapsed configuration as shown in FIG. 12 with the detents 53' and 54' releasably interengaged.

In place of link 16, one can employ a flexible, flattened, strap-like arcuate member (not shown) which extends between, and is integral with, sections 17 and 18, and with which a hook 19 and a latch assembly 14 are associated. The strap-like member need not incorporate a section 43 and may be adapted to be more flexible in some regions than others. During hanger assembly and disassembly, however, the strap-like member may have somewhat unpredictable configurations.

Those skilled in the art will readily appreciate that other and further modifications, changes, variations and the like may be made in the details and aspects of the present disclosure without departing from the spirit and scope of this invention.

What is claimed is:

1. A unitary foldable garment hanger comprising:

a) a pair of elongated arm means each having a shoulder, said shoulders being in adjacent relationship, each shoulder having a top portion and a bottom portion;

b) first hinge means interconnecting adjoining respective said bottom portions so that said arm means articulate in opposed relationship to each other between respective outwardly extended positions and lowered adjacent positions;

c) an upwardly arcuate elongated link means with opposite ends, each said opposite end being interconnected by a separate second hinge means directly to a different respective one of said top portions with said top portions being in spaced relationship to each other;

said link means being configured into a C-shape in side elevation when said arm means are in their extended positions;

said link means having a hook means which upstands therefrom when said link means is in said C-shape; and said link means having latch means which reversibly locks said link means in said C-shape with said arm means so outwardly extended;

d) said latch means comprising:

bar means that extends from said link means at a location generally adjacent to one of said second hinge means and that has a terminally defined notch, and latch means that extends from said link means at a location generally adjacent to the other one of said second hinge means and that has a terminally defined catch and lever, whereby, when said arm means are so outwardly extended, said catch is engagable with said notch; and e) a pair of detent means associated with each said arm means, said detent means being reversibly engagable with each other when said arms means are in said lowered adjacent positions.

2. The hanger of claim 1 which is openable from a disassembled storage configuration into an assembled use configuration with one hand, and which is closable from said assembled use configuration into a disassembled storage configuration with one hand.

3. The hanger of claim 1 wherein said link means incorporates a third hinge means in a mid-region thereof.

4. The hanger of claim 1 wherein each said shoulder includes a portion which abuts against the other when said arm means are in said extended positions.

5. The hanger of claim 1 wherein, when said arms are in said lowered adjacent positions, said hook means and said latch means are in non-interfering relationship with each other and with said link means and said arm means.

6. A unitary foldable garment hanger comprising:

a) a pair of longitudinally elongated garment supporting arms, each said arm having a laterally thickened shoulder with a top portion and a bottom portion;

said arms being in opposed relationship with said shoulders being longitudinally adjacent to each other so that said respective bottom portions are in contacting relationship and interconnected together by first hinge means and also so that said respective top portions are in longitudinally spaced relationship; and b) an upwardly arcuate elongated link means whose opposite ends are each directly interconnected to a different one of said top portions by a respective second and third hinge means and said link means having a fourth hinge means in a mid-region;

said arms being pivotally articulatable about said first hinge means between an outwardly extended relationship and a lowered side-by-side adjacent relationship and said shoulders including respective mutually abutting portions when said arms are in said extended relationship;

said link means and said second, third and fourth hinges being coactively movable relative to one another so that, when said arms are in said extended relationship, said link means has a generally C-shaped configuration in side elevation and extends between said second and said third hinge means, said link means also having an extending hook means which upstands therefrom when said link means is in said C-shaped configuration;

said link means further having reversibly engagable latch means for locking said opposite ends together when said link means is in said C-shaped configuration so that said arms are retainable in said outwardly extended relationship;

said latch means comprising:

bar means that extends from said link means at a location generally adjacent to said second hinge means and that has a terminally defined notch, and latch means that extends from said link means at a location generally adjacent to said third hinge means and that has a terminally defined catch and lever, whereby, when said arms are so outwardly extended, said catch is releasably engagable with said notch by manipulation of said lever, and said catch is disengagable from engagement with said notch by manipulation of said lever; and said arms being reversibly interengagable with one another when in said lowered adjacent relationship by reversibly engagable detent means associated with each one of said arms; and said hook means and said latch means being in non-interfering relationship with each other and also with said link means and said arms when said arms are in said lowered adjacent relationship.

7. The hanger of claim 6 wherein said arms, said link means, said hook means and said latch means are generally coplanar.

8. The hanger of claim 7 wherein said arms, said link means, said hook means, and said latch means have approximately equal transverse respective thickness.

9. The hanger of claim 6 wherein each said arm is comprised of an elongated longitudinally extending perimeter strip which is associated with a plurality of structurally reinforcing laterally extending, longitudinally spaced cross braces.

10. The hanger of claim 6 which is openable from a disassembled storage configuration into an assembled use configuration with one hand, and which is closable from said assembled use configuration into a disassembled storage configuration with one hand.

11. The hanger of claim 9 wherein said shoulder of each said arm is generally defined by a terminal cross brace which includes a lower section, and said lower sections comprise said abutting portions when said arms are in said extended relationship.

12. The hanger of claim 6 wherein, when said link means is in said C-shaped configuration, said configuration has a base portion and a pair of generally opposed leg portions, and said hook means has a leg portion which is joined to said link means at about the location where said base portion connects with one of said leg portions.

13. The hanger of claim 6 wherein, when said link is in said C-shaped configuration, opposed respective outside surface portions of said link adjacent said respective second and third hinge means each define a concave recess adapted for receiving a finger whereby the thumb and forefinger of one hand can apply squeezing pressure against respective different ones of said opposed outside surface portions.

* * * * *